US010292225B2

(12) United States Patent
Van De Sluis et al.

(10) Patent No.: US 10,292,225 B2
(45) Date of Patent: May 14, 2019

(54) METHODS AND APPARATUS FOR ADAPTABLE LIGHTING UNIT

(71) Applicant: SIGNIFY HOLDING B.V., Eindhoven (NL)

(72) Inventors: Bartel Marinus Van De Sluis, Eindhoven (NL); Dirk Valentinus René Engelen, Heusden-Zolder (BE); Tim Dekker, Eindhoven (NL); Dzmitry Viktorovich Aliakseyeu, Eindhoven (NL); Ramon Antoine Wiro Clout, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/722,574

(22) Filed: Oct. 2, 2017

(65) Prior Publication Data

US 2018/0027623 A1 Jan. 25, 2018

Related U.S. Application Data

(63) Continuation of application No. 14/415,678, filed as application No. PCT/IB2013/055482 on Jul. 4, 2013, now Pat. No. 9,801,244.

(60) Provisional application No. 61/673,814, filed on Jul. 20, 2012.

(51) Int. Cl.

| | |
|---|---|
| ***H05B 33/00*** | (2006.01) |
| ***H05B 33/08*** | (2006.01) |
| ***H05B 37/02*** | (2006.01) |

(52) U.S. Cl.
CPC ..... *H05B 33/0845* (2013.01); *H05B 37/0245* (2013.01)

(58) Field of Classification Search
CPC ..... H05B 37/0272; H05B 37/029; H05B 33/0803; H05B 33/0815; H05B 33/0851; H05B 33/0863; H05B 33/0896; H05B 37/0227; H05B 37/02; H05B 37/0209; H05B 37/0245
See application file for complete search history.

(56) References Cited

U.S. PATENT DOCUMENTS

| | | | | |
|---|---|---|---|---|
| 6,016,038 | A | 1/2000 | Mueller | |
| 6,211,626 | B1 | 4/2001 | Lys et al. | |
| 2010/0001703 | A1* | 1/2010 | Williams | H02M 3/1584 323/283 |

(Continued)

FOREIGN PATENT DOCUMENTS

| | | | |
|---|---|---|---|
| CN | 101513127 | A | 8/2009 |
| DE | 102010013561 | A1 | 10/2011 |

(Continued)

*Primary Examiner* — Monica C King
(74) *Attorney, Agent, or Firm* — Meenakshy Chakravorty

(57) ABSTRACT

Disclosed are methods and apparatus for a lighting unit that may adaptably achieve a plurality of lighting effects. A plurality of LEDs (541A-G, 641) producing a light output having at least one adaptable light output characteristic may be provided and controlled by a controller 650 electrically coupled to the plurality of LEDs (541A-G, 641). The controller may control the at least one adaptable light output characteristic in accordance with received lighting configuration data that is specific to a particular lighting implementation.

6 Claims, 5 Drawing Sheets

(56) References Cited

U.S. PATENT DOCUMENTS

| | | | | |
|---|---|---|---|---|
| 2010/0141153 | A1* | 6/2010 | Recker ..... | H05B 33/0803<br>315/149 |
| 2010/0194589 | A1 | 8/2010 | Burmeister | |
| 2014/0159924 | A1 | 6/2014 | Lee | |

FOREIGN PATENT DOCUMENTS

| | | | |
|---|---|---|---|
| GB | 2453540 | A | 4/2009 |
| JP | 2010503168 | A | 1/2010 |

* cited by examiner

METHODS AND APPARATUS FOR ADAPTABLE LIGHTING UNIT

CROSS-REFERENCE TO PRIOR APPLICATIONS

This application is a divisional of U.S. patent application Ser. No. 14/415,678, filed on Jan. 19, 2015, which is a U.S. National Phase application under 35 U.S.C. § 371 of International Application No. PCT/IB2013/055482, filed on Jul. 4, 2013, which claims the benefit of U.S. Provisional Patent Application No. 61/673,814, filed on Jul. 20, 2012. These applications are hereby incorporated by reference herein.

TECHNICAL FIELD

The present invention is directed generally to an adaptable lighting unit. More particularly, various inventive methods and apparatus disclosed herein relate to an LED-based lighting unit that may adaptably achieve a plurality of lighting effects.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

Manufacturers currently offer a large number of different lighting units for implementation in lighting fixtures. Each lighting unit often has a different form factor and/or creates a different type of lighting effect. For example, thousands of different LED-based lighting units may be offered, with each including a unique form factor and/or the capability of producing a unique lighting effect. Each of the LED-based lighting units may optionally be optimized for a specific lighting fixture and/or specific intended application. However, some customers may have difficulty in choosing an appropriate lighting unit from the variety of different lighting units that are offered.

Thus, there is a need in the art to provide a lighting unit that may adaptably achieve a plurality of lighting effects and that may optionally overcome one or more drawbacks of conventional approaches.

SUMMARY

The present disclosure is directed to inventive methods and apparatus for a lighting unit that may adaptably achieve a plurality of lighting effects. For example, a plurality of LEDs producing a light output having at least one adaptable light output characteristic may be provided and controlled by a controller electrically coupled to the plurality of LEDs. The controller may control the at least one adaptable light output characteristic in accordance with received lighting configuration data that is specific to a particular lighting implementation.

Generally, in one aspect, the invention relates to an adaptable LED-based lighting unit that includes a plurality of LEDs producing a light output having at least one adaptable light output characteristic, and a controller electrically coupled to the plurality of LEDs and controlling the at least one adaptable light output characteristic in accordance with received lighting configuration data. The lighting configuration data is selected from a set of predefined lighting configuration data, is received in response to integration of the LEDs within a particular lighting implementation, and is specific to the particular lighting implementation.

In some embodiments, the lighting unit includes at least one storage medium in communication with the controller, which stores the lighting configuration data and transmits the lighting configuration data in response to integration of the LEDs within the particular lighting implementation. In some versions of those embodiments, the controller requests the lighting configuration data from the storage medium in response to receiving lighting implementation data indicative of the particular lighting implementation. The lighting implementation data and the lighting configuration data may optionally be correlated to one another in a look up table of the storage medium. The lighting implementation data may optionally include at least one of the following: specific lighting fixture, lighting fixture type, lighting fixture shape, and specific lighting effect. The lighting unit may optionally further include an RFID reader which receives the lighting implementation data and transmits the lighting implementation data to the controller.

In some embodiments, the lighting unit further includes an RFID reader which receives the lighting configuration data and transmits the lighting configuration data to the controller.

In some embodiments, of the lighting unit at least one of the adaptable light output characteristics is a dynamic light output characteristic.

In some embodiments of the lighting unit at least one of the adaptable light output characteristics is dimming that is controlled in accordance with the lighting configuration data.

Generally, in another aspect, the invention relates to an adaptable LED-based lighting system that includes a lighting configuration transmitter at least selectively transmitting predefined lighting configuration data, an LED-based lighting unit having a plurality of LEDs, and a controller electrically coupled to the plurality of LEDs. The controller adjusts at least one light output characteristic of the LEDs to achieve a predefined lighting configuration of a plurality of predefined lighting configurations, the predefined lighting configuration being correlated with received lighting configuration data. The lighting configuration data is received in response to integration of the LEDs within a particular lighting implementation.

In some embodiments of the lighting system, the controller requests the lighting configuration data in response to receiving lighting implementation data indicative of the particular lighting implementation. In some versions of those embodiments, the lighting implementation data and the lighting configuration data are correlated to one another in a look up table. The lighting implementation data may optionally include at least one of the following: specific lighting fixture, lighting fixture type, lighting fixture shape, and specific lighting effect. The lighting configuration transmitter may optionally be a storage medium or an RFID tag.

In some embodiments of the lighting system, the predefined lighting configuration data includes primary desired lighting configuration data and secondary default lighting configuration data.

In some embodiments of the lighting system, the controller individually adjusts the light output characteristic of individual LED groups of the LEDs to achieve the predefined lighting configuration.

Generally, in another aspect, a method of adapting an LED-based lighting unit to a particular lighting implementation is provided that includes the steps of: monitoring for lighting implementation data indicative of a particular lighting implementation, requesting predefined lighting configuration data corresponding to the lighting implementation data, receiving the predefined lighting configuration data, and adjusting at least one light output characteristic of LEDs of an LED-based lighting unit to achieve a predefined lighting configuration correlated with received lighting configuration data.

In some embodiments, the lighting implementation data includes at least one of the following: specific lighting fixture, lighting fixture type, lighting fixture shape, and specific lighting effect.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, and other types of electroluminescent sources.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

The terms "lighting fixture" and "luminaire" are used interchangeably herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Manufacturers currently offer a large number of different lighting units for implementation in lighting fixtures. Each lighting unit often has a different form factor and/or creates a different type of lighting effect. Each of the lighting units may optionally be optimized for a specific lighting fixture and/or specific intended application. Some customers may have difficulty in choosing an appropriate lighting unit from the variety of different lighting units that are offered. Thus, Applicants have recognized and appreciated that it would be beneficial to provide a lighting unit that may adaptably achieve a plurality of lighting effects and that may optionally overcome one or more drawbacks of previous lighting units.

More generally, Applicants have recognized and appreciated that it would be beneficial to provide various inventive methods and apparatus that relate to an LED-based lighting unit that may adaptably achieve a plurality of lighting effects.

In view of the foregoing, various embodiments and implementations of the present invention are directed to an adaptable LED-based lighting unit.

Figure 1A:
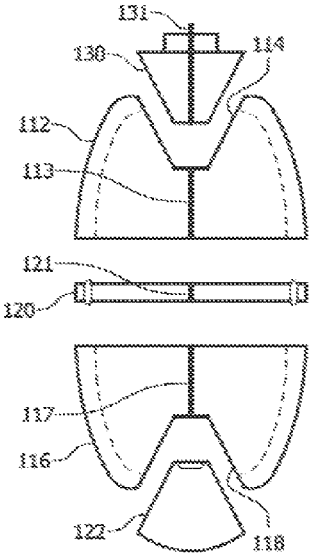
FIG. 1A illustrates various adaptable lighting unit modules.

FIG. 1A illustrates various adaptable lighting unit modules that may interface with one another and/or other adaptable lighting unit modules to create a desired adaptable modular lighting unit. The adaptable lighting unit modules include a first end diffuse lighting unit module 112 having a recess 114 therein and a second end diffuse lighting unit module 116 having a recess 118 therein. The adaptable lighting unit modules also include a linearly extending intermediary diffuse lighting unit module 120 and a spotlighting unit module 122. Each of the diffuse lighting unit modules 112, 116, 120 include one or more light sources and produce a diffuse light output. For example, one or more of the diffuse lighting unit modules 112, 116, 120 may include a plurality of LEDs that are paired with diffusing optics (e.g., refracting and/or reflecting optics that are each provided over one or more LEDs) and/or that are covered by a diffuse lens or other diffuse material provided over the LEDs. The spotlighting unit module 122 includes one or more light sources that produce a spot type light type output. For example, the spotlighting unit module 122 may include one or more LEDs that are paired with one or more collimating optics to direct a spot type light output in a general desired direction. One or more of the lighting unit modules 112, 116, 120, and 122 have one or more adjustable light output characteristics. For example, in some embodiments each of the lighting unit modules 112, 116, 120, and 122 has a plurality of adjustable light output characteristics such as one or more of those described herein.

The recesses 114, 118 are generally in the shape of a frustum of a pyramid and may interface with another adaptable lighting unit module, such as spotlight adaptable lighting unit module 122, and/or may optionally interface with another lighting fixture component such as communications, power, and control module 130. Communications, power, and control module 130 may include one or more drivers for powering the light sources of the adaptable lighting unit modules 112, 116, 120 and/or 122. For example the communications, power, and control module 130 may include an LED driver for powering LEDs of the adaptable lighting unit modules 112, 116, 120 and/or 122. The communications, power, and control module 130 may also include a power source and/or a connection for an external power source to enable powering of the adaptable lighting unit modules 112, 116, 120 and/or 122. For example, power line 131 may be coupled to an external power source and may be electrically coupled to power lines 113, 117, and/or 121 of the adaptable lighting unit modules 112, 116, and/or 120 to provide power to the adaptable lighting unit modules 112, 116, 120 and/or 122.

The communications, power, and control module 130 may also include a controller for adjusting one or more light output characteristics of the adaptable lighting unit modules 112, 116, and/or 120. For example, the communications, power, and control module 130 may include a controller in combination with an LED driver thereof that may manipulate the LED driver output parameters to thereby alter light output characteristics of the adaptable lighting unit modules 112, 116, and/or 120.

The communications, power, and control module 130 may also include a transmitter and/or a receiver for communications with one or more of the adaptable lighting unit modules 112, 116, 120 and/or 122 and/or for communication with other components (e.g., another device providing lighting implementation data and/or lighting configuration data). For example, the communications, power, and control module 130 may include a receiver for receiving lighting implementation data and/or lighting configuration data and may adjust one or more parameters of a driver in accordance with such data. Also, for example, the communications, power, and control module 130 may include a receiver for receiving data from one or more lighting unit modules 112, 116, 120 and/or 122 to enable determination of one or more parameters of such modules and may optionally adjust one or more parameters of a driver in accordance with such data.

Figure 1B:
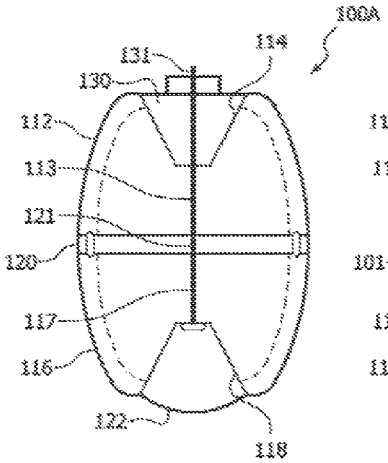
FIG. 1B illustrates the adaptable lighting unit modules of FIG. 1A integrated to form a modular adaptable lighting unit.

Any transmitter and/or receiver may optionally utilize one or more communications mediums, communications technologies, protocols, and/or inter-process communication techniques. For example, the communication mediums may include any physical medium, including, for example, twisted pair coaxial cables, fiber optics, and/or a wireless link using, for example, infrared, microwave, or encoded visible light transmissions and any suitable transmitters, receivers or transceivers to effectuate communication in the lighting fixture network. Also, for example, the communications technologies may include any suitable protocol for data transmission, including, for example, TCP/IP, variations of Ethernet, Universal Serial Bus, Bluetooth, FireWire, Zigbee, DMX, Dali, 802.11b, 802.11a, 802.11g, token ring, a token bus, serial bus, power line networking over mains or low voltage power lines, and/or any other suitable wireless or wired protocol FIG. 1B illustrates the adaptable lighting unit modules of FIG. 1A integrated to form a first modular adaptable lighting unit 100A. The first modular adaptable lighting unit 100A is substantially circular in cross-section (a cross-section perpendicular to the page). The communications, power, and control module 130 has been received within the recess 114 of the first end diffuse lighting unit module 112 and the spotlighting unit module 122 has been received with the second end diffuse lighting unit module 116. The diffuse lighting unit modules 112, 116, and 120 have also been coupled to one another. Sockets and/or other connectors may optionally be utilized. The power lines 131, 113, 121, and 117 have also been electrically coupled to one another and are electrically coupled to the spotlighting unit module 122.

In some embodiments, one or more of the lighting unit modules 112, 116, 120, and 122 may have one or more adjustable light output characteristics such as one or more of those described herein. Such light output characteristics may be adjusted based on the particular lighting implementation. For example, the light output characteristics may be adjusted by the communications, power, and control module 130 based on determination of which other lighting unit modules are being utilized in the first modular adaptable lighting unit 100A. For instance, the light output intensity of each of the lighting unit modules 112, 116, 120, and 122 may be set and/or dynamically adjustable based on analysis of the light output capabilities of each of the lighting unit modules 112, 116, 120, and 122. Also, for instance, the power provided to each of the lighting unit modules 112, 116, 120, and 122 may be set and/or dynamically adjustable based on analysis of the power consumption of all of the lighting unit modules 112, 116, 120, and 122 to maintain power consumption below a desired level (e.g., due to heat and/or energy constraints). Also, for instance, lighting implementation data may be received indicating that the adaptable lighting unit 100A is installed in a particular implementation and one or more of light output intensity, beam width, color temperature, and/or distribution characteristics of each of the lighting unit modules 112, 116, 120, and 122 may be set and/or dynamically adjustable to achieve light output in accordance with such particular implementation.

Figure 1C:
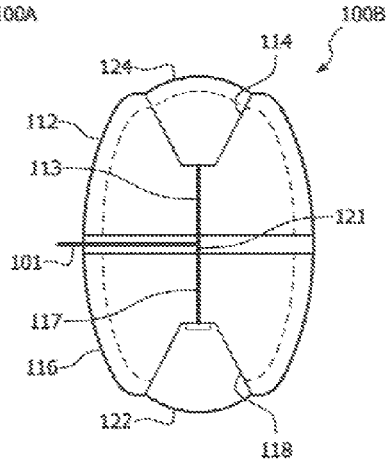
FIG. 1C illustrates certain of the adaptable lighting unit modules of FIG. 1A and an additional diffuse adaptable lighting unit module that are integrated to form another modular adaptable lighting unit.

FIG. 1C illustrates certain of the adaptable lighting units of FIG. 1A and an additional diffuse adaptable lighting unit module 124 that are integrated to form a second modular adaptable lighting unit 100B. The second modular adaptable lighting unit 100B is substantially circular in cross-section. In FIG. 1C a diffuse lighting unit module 124 is received with the recess 114 of the first end diffuse lighting unit module 112 and powering, communications, and/or control is received from a side connection 101. In some embodiments one or more of the lighting unit modules 112, 116, 120, 122, and 124 may have one or more adjustable light output characteristics such as one or more of those described herein.

Figure 2A:
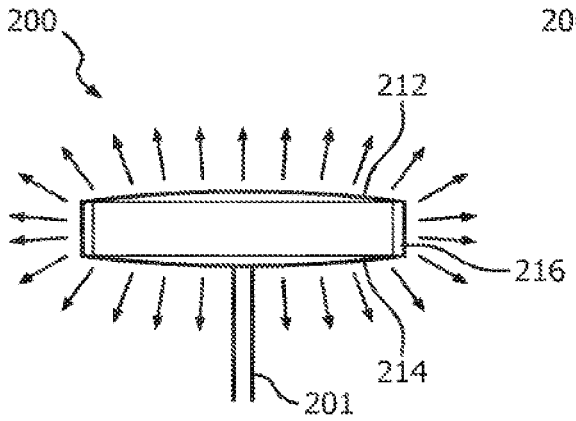
FIG. 2A illustrates a puck-shaped adaptable lighting unit generating a first light output generally directed in all directions.
Figure 2B:
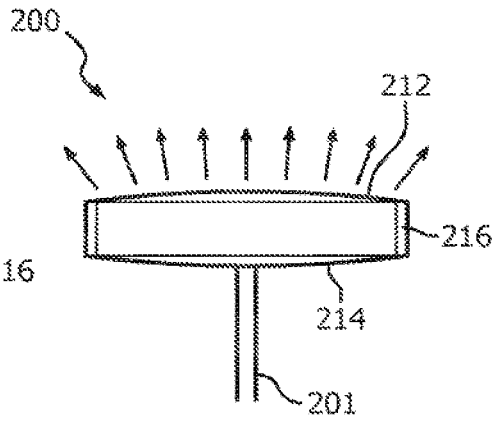
FIG. 2B illustrates the puck-shaped adaptable lighting unit of FIG. 2A generating a second light output generally directed in an upward direction.

FIG. 2A illustrates a puck-shaped adaptable lighting unit 200 generating a first light output (generally represented by arrows emanating from the lighting unit 200) that is generally directed in all directions. FIG. 2B illustrates the puck-shaped adaptable lighting unit 200 generating a second light output (generally represented by arrows emanating from the lighting unit 200) that is generally directed in an upward direction. The puck-shaped adaptable lighting unit 200 includes an outer shell having an upper surface 212, a lower surface 214, and a perimeter surface 216. The outer shell is translucent and encloses a plurality of LEDs. In some embodiments the LEDs may include LEDs generating a collimated beam with a fine grained control. An external power connection 201 may provide power to the LEDs of the puck-shaped adaptable lighting unit 200 and may optionally provide lighting configuration data to a controller of the puck-shaped adaptable lighting unit 200. In some embodiments, of the puck-shaped adaptable lighting unit 200 it may not be desirable or possible to drive all of the LEDs at full power. Power may instead be distributed over a sub range of the LEDs (e.g., as illustrated in FIG. 2B) and/or all of the LEDs may be driven at a lower intensity. The particular light output distribution may be generated in accordance with predefined lighting configuration data received in response to integration of the puck-shaped adaptable lighting unit with a particular lighting implementation.

Figure 3A:
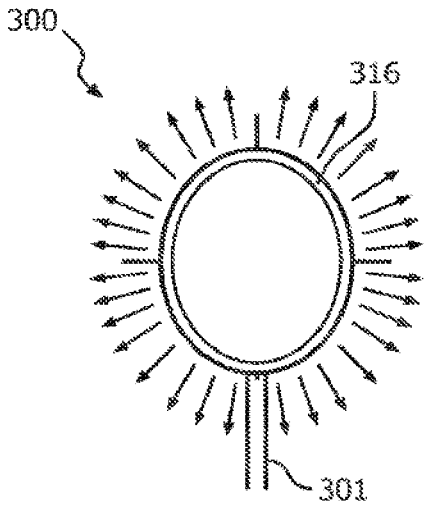
FIG. 3A illustrates an oval-shaped adaptable lighting unit generating a first light output generally directed in a radial direction three-hundred-sixty degrees around.
Figure 3B:
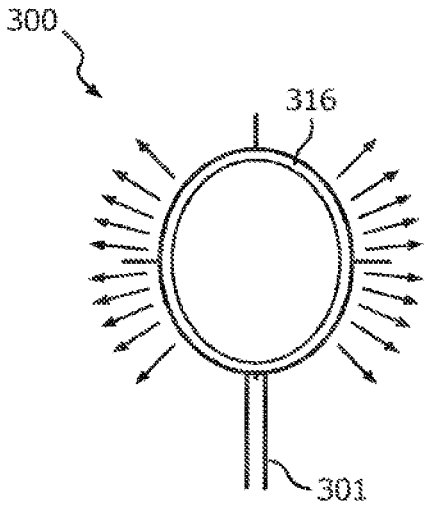
FIG. 3B illustrates the oval-shaped adaptable lighting unit of FIG. 3A generating a second light output generally directed in a radial direction approximately two-hundred-forty degrees around.

FIG. 3A illustrates an oval-shaped adaptable lighting unit 300 generating a first light output (generally represented by arrows emanating from the lighting unit 300) that is generally directed in a radial direction three-hundred-sixty degrees around. FIG. 3B illustrates the oval-shaped adaptable lighting unit 300 generating a second light output (generally represented by arrows emanating from the lighting unit 300) that is generally directed in a radial direction approximately two-hundred-forty degrees around (with two approximately sixty degree gaps).

The oval-shaped adaptable lighting unit 300 includes an outer shell having a radial light emitting surface 316. At least the perimeter of the outer shell is translucent and encloses a plurality of LEDs. In some embodiments the LEDs may include LEDs generating a collimated beam with a fine grained control. An external power connection 301 may provide power to the LEDs of the oval-shaped adaptable lighting unit 300 and may optionally provide lighting configuration data to a controller of the puck-shaped adaptable lighting unit 300. In some embodiments of the oval-shaped adaptable lighting unit 300 it may be desirable to directionally control the light output from the LEDs. For example, as illustrated in FIG. 3B only certain of the LEDs may be illuminated to only provide partial radially arranged light output.

In some embodiments, the directionality of the lighting may be controlled by a directionality data communication optionally provided with received lighting configuration data (e.g., provided over power connection 301 or in combination with received lighting configuration data). For example, in some embodiments directionality of the lighting can be controlled by two bytes. For instance, in some embodiments the first light output of FIG. 3A may be generated in response to a directionality data communication of "11111111 11111111" and the second light output of FIG. 3B may be generated in response to a directionality data communication of "00011111 11110000." Other light outputs may be generated in response to other directionality data communication. The particular implemented light output may correspond to predefined lighting data receive in response to integration of oval-shaped lighting unit 300 in a particular implementation.

Figure 4A:
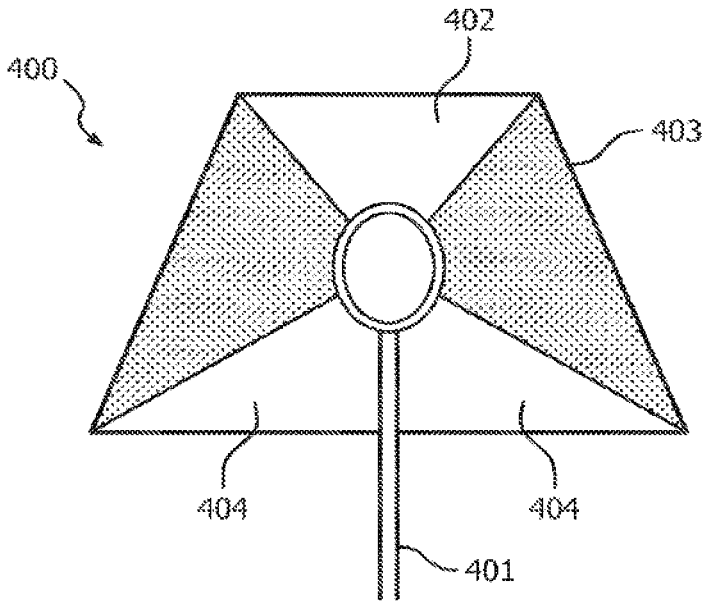
FIG. 4A illustrates a lighting fixture having an adaptable lighting unit generating a first light output with uplighting and downlighting.
Figure 4B:
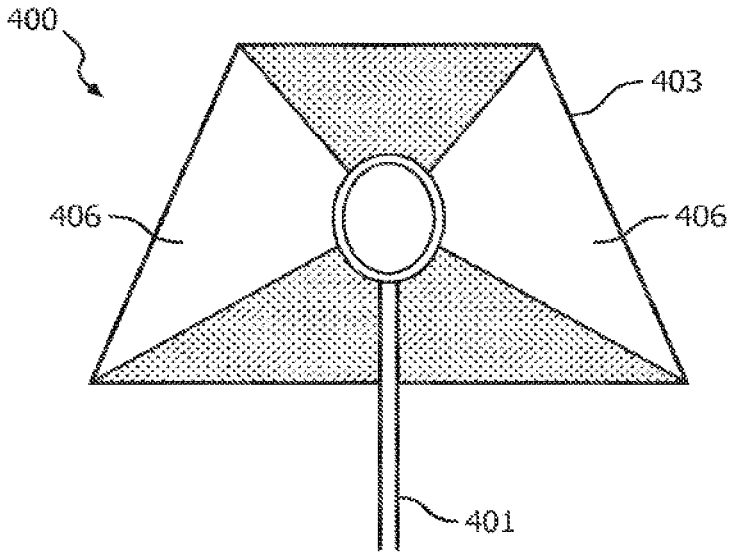
FIG. 4B illustrates the lighting fixture of FIG. 4A with the adaptable lighting unit generating a second light output with shade lighting.

FIGS. 4A and 4B illustrate a lighting fixture having an adaptable lighting unit 400 mounted atop a pole 401 and surrounded by a lamp shade 403 (and without uplighting 402 and downlighting 404). The adaptable lighting unit 400 is able to create segmented lighting effects. For example, in FIG. 4A the lighting unit 400 is generating a first light output with uplighting 402 and downlighting 404. Also, for example, in FIG. 4B the adaptable lighting unit 400 is generating a second light output with shade lighting 406 directed toward the shade 403. Additional and/or alternative segmented lighting effects may optionally be achievable from adaptable lighting unit 400.

In some embodiments the segmented output, the intensity, and/or other characteristic of the light output of the lighting unit 400 may be adjusted based on received lighting configuration data. For example, in some embodiments an RFID tag may be installed on the shade 403 that may provide lighting implementation data to an RFID reader of the lighting unit 400 that is indicative of the intended lighting implementation of the lighting fixture (e.g., for reading, for ambient lighting only, and/or for uplighting). The adaptable lighting unit 400 may then obtain lighting configuration data (e.g., from local memory) corresponding to the intended lighting implementation and adjust light output characteristics of the adaptable lighting unit 400 accordingly. For instance, if the intended lighting implementation is for ambient lighting and uplighting only, the lighting configuration data may be utilized to adjust adaptable lighting unit 400 to be configured to cycle through providing shade lighting 406 only, uplighting 402 only, and a combination of shade lighting 406 and uplighting 402.

Figure 5A:
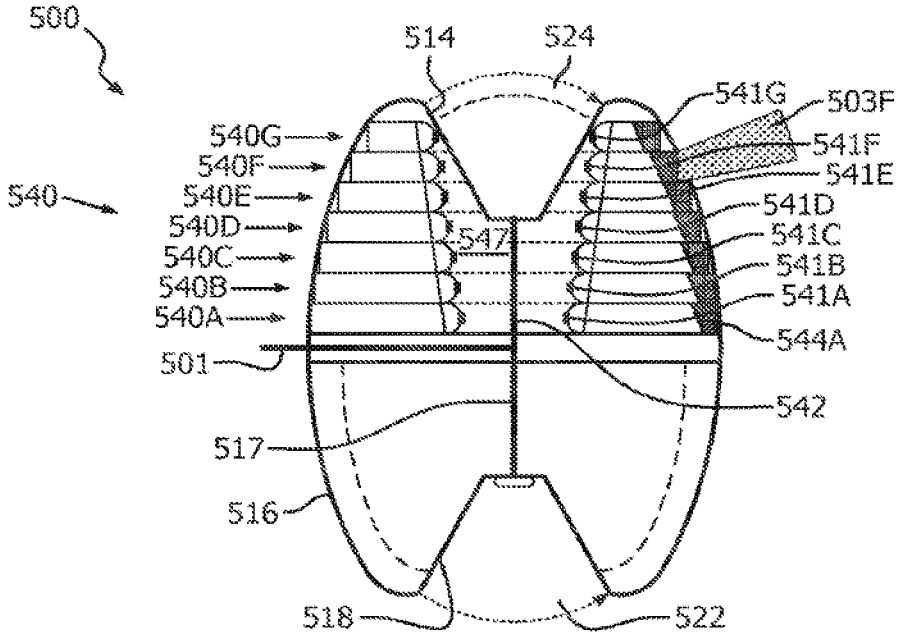
FIG. 5A illustrates a side section view of another modular adaptable lighting unit having a multiple layer adaptable lighting unit module having multiple light emitting layers.

FIG. 5A illustrates a side section view of another modular adaptable lighting unit 500 having a multiple layer adaptable lighting unit module 540 with multiple light emitting layers 540A-G. In FIG. 5A a diffuse lighting unit module 524 is received within a recess 514 of the multiple layer adaptable lighting unit module 540 and powering, communications, and optionally control is received from a side connection 501. A spotlighting unit module 522 has been received within a recess 518 of end diffuse lighting unit module 516. The diffuse lighting unit modules 516, 522, 524, and 540 have also been coupled to one another. The power lines 501, 517, and 542 have also been electrically coupled to one another and are electrically coupled to the spotlighting unit module 522 and the diffuse lighting unit module 524.

The light emitting layers 540A-G are stacked atop one another in a stair-stepped arrangement. The light emitting layers 540A-G surround a concentric recess 549 in the multiple layer adaptable lighting unit module 540. A plurality of LEDs 541A-G are arranged in the recess 514 interior of the light emitting layers 540A-G and produce light output directed toward respective light emitting layers 540A-G. In some embodiments the LEDs 541A-G associated with each of the light emitting layers 540A-G may be individually controlled to enable individual control of light output from each of the light emitting layers 540A-G. In some embodiments a groups of one or more LEDs 541A-G directed toward a single layer 540A-G may be individually controlled. For example, as illustrated in FIG. 5A only one LED 541F may be illuminated to only illuminate a segment of light emitting layer 540F and produce a collimated beam 503F.

Figure 5B:
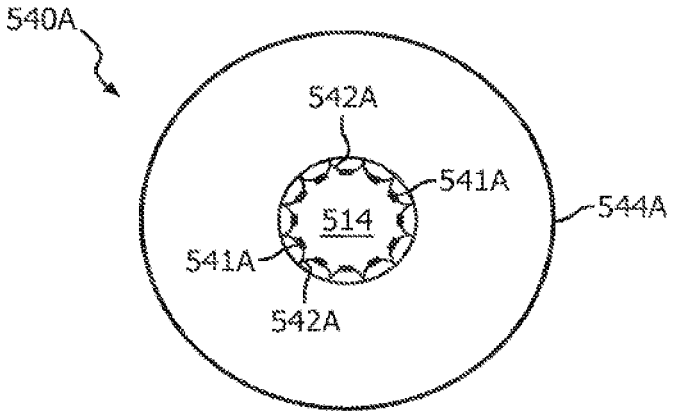
FIG. 5B illustrates a top section view of one of the light emitting layers of the multiple layer adaptable lighting unit module of FIG. 5A.
Figure 5C:
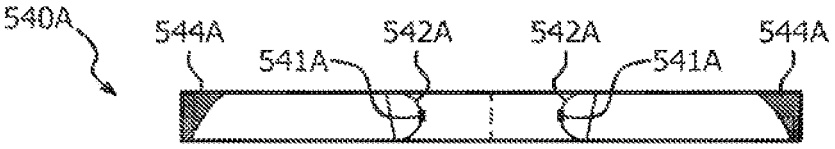
FIG. 5C illustrates a side section view of one of the light emitting layers of the multiple layer adaptable lighting unit module of FIG. 5A.

Referring to FIGS. 5B and 5C, a top section view of the light emitting layer 540A and a side section view of the light emitting layer 540A are illustrated. In some embodiments one or more of the other light emitting layers 540B-F may have configurations that are similar to the light emitting layer 540A. A plurality of LEDs 541A are circularly arranged around the recess 514 interior of the light emitting layer 540A. Each of the LEDs 541A is positioned so that light output therefrom is directed toward the light emitting layer 540A and is coupled with a collimator 542A to ensure light output therefrom is directed toward the light emitting layer 540A. Light from the LEDs 541A enters into the light emitting layer 540A and exits as light output from the periphery of the light emitting layer 540A. In some embodiments groups of one or more of the LEDs 541A may be individually controllable (e.g., may be individually turned on/off, may have brightness individually controlled, and/or may have color individually controlled). An outcoupling optic 544A may optionally be provided along all or a portion of the periphery of the light emitting layer 540A to ensure exiting light is coupled out in a collimated beam with a desired angle and/or direction. In some embodiments the light emitting layer 540A may include Poly methyl methacrylate (PMMA).

In some embodiments one or more of the lighting unit modules 516, 522, 524, and 540 may have one or more adjustable light output characteristics such as one or more of those described herein. Such light output characteristics may be adjusted based on the particular lighting implementation as conveyed via received lighting configuration data. For example, the light output characteristics of each light emitting layer 540A-G may be individually adjusted to accommodate a particular installation location. For instance, to achieve desired cut-off only certain of the light emitting layers 540A-G may be illuminated and/or to achieve a certain distribution only certain of the LEDs 541A-G within an illuminated light emitting layers 540A-G may be illuminated.

Figure 6:
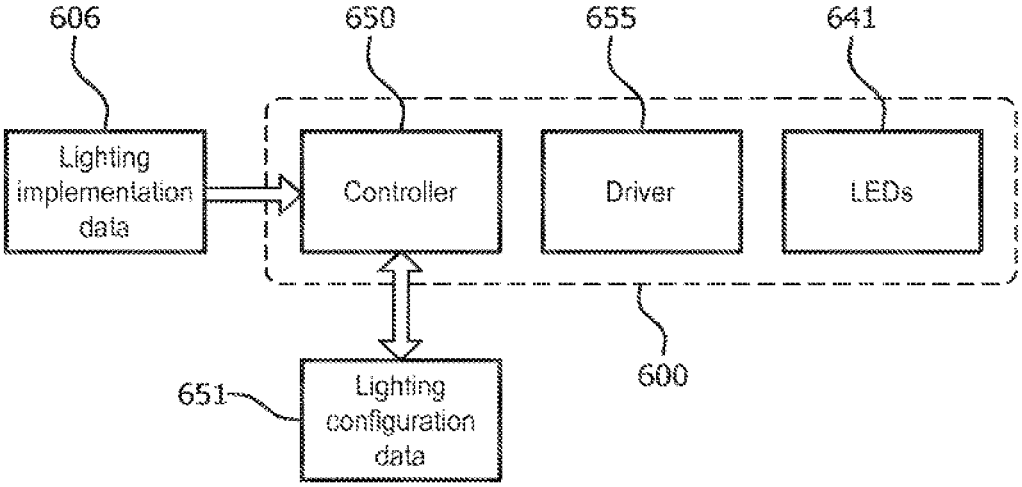
FIG. 6 illustrates a schematic diagram of an embodiment of an adaptable LED-based lighting system.

FIG. 6 illustrates a schematic diagram of an embodiment of an adaptable LED-based lighting system. The adaptable LED-based lighting system includes an adaptable LED-based lighting unit 600 having a controller 650, a driver 655, and a plurality of adjustable LEDs 641. In some embodiments the controller 650 and/or driver 655 may be provided separate from the LED-based lighting unit 600. In some embodiments the controller 650 and the driver 655 may be integrated as a single component. In some embodiments the adaptable LED-based lighting unit 600 and adaptable lighting units 100A, 1006, 200, 300, 400, and/or 500 may share one or more common aspects. In some embodiments the adaptable LED-based lighting unit 600 may be replaced and/or supplemented with one or more of adaptable lighting units 100A, 1006, 200, 300, 400, and/or 500.

Lighting configuration data 651 is supplied to the controller 650 to enable the controller 650 to adjust one or more adaptable light output characteristics of the LEDs 641 in accordance with the lighting configuration data 651. The supplied lighting configuration data 651 is specific to one or more aspects of the particular lighting implementation within which the adaptable lighting unit 600 is implemented. For example, the adaptable lighting unit 600 may be installable with a plurality of lighting fixture types and may be operable with different light output characteristics for each of the different lighting fixture types. The supplied lighting configuration data 651 may enable the controller 650 to appropriately adjust light output produced by the LEDs 641 in accordance with the lighting configuration data 651. For example, the controller may adjust characteristics of the driver 655, sensor inputs, optics paired with the LEDs 641, and/or one or more adjustable surfaces supporting the LEDS 641 to adjust the characteristics of light output produced by the LEDs 641.

In some embodiments, the lighting configuration data 651 may be implemented in memory associated with the controller 650. In some embodiments the lighting configuration data 651 may be stored elsewhere (e.g., lighting fixture, external database) and sent to the controller 650 using one or more communication protocols and/or communication mediums.

In some embodiments, the controller 650 may receive lighting implementation data 606 representing a particular lighting implementation within which the LED-based lighting unit 600 is implemented; may associate the lighting implementation data 606 with corresponding lighting configuration data 651; may receive the corresponding lighting control data 651; and may control the LEDs 641 in accordance with the lighting configuration data 651.

In some embodiments, the lighting implementation data 606 may include identification of one or more of an identifier representing a specific lighting fixture (e.g. Philips Lirio Posada white LI 37362/31/LI), lighting fixture type (e.g. wall-mounted white shade or arm creating ambient light) or a specific lighting effect (e.g. "effect nr 131"). In some embodiments the lighting implementation data 606 may be received via an RFID tag reader integrated in the LED-based lighting unit 600. The RFID tag reader may detect an RFID tag integrated in the lighting fixture or in a specific lighting fixture part (such as an interchangeable lamp shade or diffusing plate). The LED-based lighting unit 600 or other lighting part may also optionally be offered with "RFID tag stickers" enabling end-users to "retrofit" their "old" luminaires. For example, a plurality of RFID tag stickers may be provided in combination with the LED-based lighting unit 600 with each being configured for a different lighting fixture type within which the LED-based lighting unit 600 may be utilized. A user may select an appropriate RFID tag sticker and install the RFID tag sticker on the lighting fixture within which the LED-based lighting unit 600 is to be implemented.

In some embodiments, the lighting implementation data 606 may be received via a network. For example, if the LED-based lighting unit 600 is IP connected (e.g., directly or using a ZigBee-Wifi bridge), a user may utilize a mobile device (e.g., smartphone or tablet computer) to send the lighting implementation data 606 to the LED-based lighting unit 600. For example, this may done by selecting the lighting fixture from a catalog in an application executing on the mobile device, typing in the serial number of the lighting fixture (e.g., shown on the package), or capturing a QR code with the mobile device (e.g., on the package of the lighting fixture or back of the lighting fixture).

In some embodiments, the lighting implementation data 606 may be received via an active communication element such as ZigBee or other RF communication that is activated when the LED-based lighting unit 600 is implemented in the lighting fixture. For example, the active communication element may be part of the lighting fixture within which the LED-based lighting unit 600 is installed and may broadcast the lighting implementation data 606.

In some embodiments, once lighting implementation data 606 has been detected, the lighting implementation data 606 may be associated with appropriate lighting configuration data 651 utilizing a look-up table which maps the lighting implementation data 606 to a set of associated lighting configuration data 651. In some embodiments the look up table may be located within local memory coupled to the controller 650. In some embodiments the controller 650 may be connected to a network and the network may be utilized to identify lighting configuration data 651 that is associated with lighting implementation data 606.

In some embodiments, a device may directly provide the lighting configuration data 651 to the LED-based lighting unit 600 and optionally not provide the lighting implementation data 606. For example, the lighting fixture within which the LED-based lighting unit 600 is installed may provide the lighting configuration data 651 directly to the multi-effect LED module. The lighting configuration data 651 may be stored locally at the lighting fixture (e.g., a controller of the lighting fixture), or in an electronic device embedded in the lighting fixture. The lighting configuration data 651 may optionally include priority data that indicates whether the lighting configuration data 651 represents "allowed" settings for the lighting fixture, or represents "preferred" settings for the lighting fixture. Allowed settings are settings that must be implemented to enable operation of the LED-based lighting unit 600 within the lighting fixture. In other words, if the LED-based lighting unit 600 is incapable of operating the allowed settings it may be prevented from operating in the lighting fixture. Preferred settings for the lighting fixture represent settings that are preferable to be implemented, but operation of the LED-based lighting unit 600 within the lighting fixture is still enabled if the LED-based lighting unit 600 is incapable of implementing the settings.

In some embodiments, a physical connection is used to set up a communications connection between the LED-based lighting unit 600 and the lighting fixture to enable the lighting fixture to directly provide the lighting configuration data 651. For example, wiring, connectors, USB connection, and/or electronic communication bus (e.g., a serial bus, power line communication, and/or USB connection) may be utilized to communicate lighting configuration data 651 to the LED-based lighting unit 600.

In some embodiments, the lighting fixture can communicate a set of primary light output characteristics (light distribution, color temperature, etc.) in the lighting configuration data 651 that are compatible with the lighting fixture. Additionally, the lighting fixture can communicate an alternative set of light output characteristics in the lighting configuration data 651 if the LED-based lighting unit 600 is not capable of fully reproducing the desired primary light output characteristics. The lighting fixture may also provide in the lighting configuration data 651 a mode of operation that defines which light output characteristics are controllable by one or more user interface and/or parameters and ranges of the controllable light output characteristics (e.g., it can define how dimming should operate). In some embodiments a lighting fixture may contain a plurality of LED-based lighting units and one or more of such LED-based lighting units may provide lighting configuration data 651 to other of the LED-based lighting units.

The light output characteristics that may be contained in the lighting configuration data 651 may include one or more of a plurality of adjustable light output related characteristics of a light source. For example, some light output characteristics may relate to a single light output characteristics such as static light output characteristics and/or dynamic light output characteristics. For instance, a simple fade-in/fade-out may be defined which makes one or more of the LEDs 641 of the LED-based lighting unit 600 switch on and off in a gentle fading manner.

Also, for example, some light output characteristics may relate to a set of lighting output characteristics such as a set of static light output characteristics and/or dynamic light output characteristics. For instance, the lighting fixture and/or a connected device (e.g., a mobile device) may offer a user interaction means enabling a user to select a desired lighting effect from a set of lighting effects set in accordance with the lighting configuration data 651.

Also, for example, some light output characteristics may relate to one or more adaptive or interactive lighting effects. For instance, a dynamic lighting effect may be implemented in the LED-based lighting unit 600 that changes based on sensor input and/or user input based on settings obtained via the lighting configuration data 651.

Also, for example, some light output characteristics may relate to a range of lighting effects. For instance, instead of defining a set of separate effects, a range of effects may be defined by particular parameter ranges allowing specific variations in light output characteristics such as intensity, beam width, color temperature or light distribution over defined segments of LED-based lighting unit 600. During operation, the LED-based lighting unit 600 may control those parameters within the defined ranges based on, intra alia: (1) user interface input (e.g., using the luminaire UI, or using UI means on a connected device such as remote control or smartphone) or (2) sensor input (e.g., ambient light intensity, proximity of people, sensed mood in a room, the amount of people present, etc.). Any utilized sensors may be available in the LED-based lighting unit 600, in the lighting fixture, and/or in other connected devices in the proximity of the LED-based lighting unit 600.

In some embodiments, the controller 650 may interface with the driver 655 to enable each individual LED to be driven with the proper parameters in order to create the desired light output characteristic. In some embodiments a specific lighting fixture can have a set of predefined lighting configuration data associated with it and a selected of the predefined lighting configuration data 651 will be supplied to the LED-based lighting unit 600. In some embodiments the supplied lighting configuration data 651 may be dependent on the type of LED-based lighting unit 600. In some embodiments the supplied lighting configuration data 651 may additionally and/or alternatively be dependent on one or more additional factors. For example, in some embodiments lighting configuration data 651 is selected based on other inputs such as time/date input from specific sensors. For instance, an outdoor lamp may provide different lighting configuration data 651 based on a variety of parameters, such as time of day, ambient light level, presence and/or proximity of a person, etc. An atmosphere lamp in the living room, however, may offer a set of pre-defined light scenes to a user through a user interface. This set of light scenes may also optionally be dependent on detected activities in the room (e.g., detection of kids or detection of party crowd) or time of year (e.g. specific Spring or Christmas scenes). Lighting settings do not have to be static, but may also include dynamic scenes which gradually change over time (e.g. a wake up experience) or adaptive scenes which change upon sensor input (e.g. gradually increase of light intensity upon detecting dawn or arrival of people).

In addition to or as an alternative to adaptable light output characteristics, it is also possible to activate particular user interaction features for specific lighting fixtures. For instance, for a lighting fixture which is quite open and usually within reach of its users, the LED-based lighting unit may support touch control by touching the module. Also, for instance, if a pendant ceiling lighting fixture is open at the bottom side, specific gestures underneath the LED-based lighting unit may enable control of the LED-based lighting unit.

Figure 7:
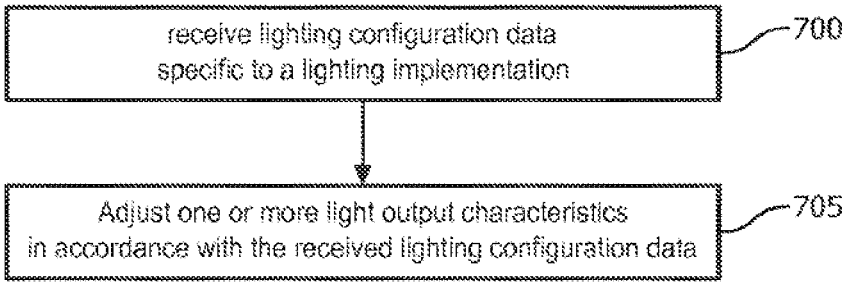
FIG. 7 illustrates a flow chart of an embodiment of a method of adapting an LED-based lighting unit to a particular lighting implementation.

FIG. 7 illustrates a flow chart of an embodiment of a method of adapting an LED-based lighting unit to a particular lighting implementation. Other embodiments may perform the steps in a different order, omit certain steps, and/or perform different and/or additional steps than those illustrated in FIG. 7. In some embodiments a controller, such as controller 650 and/or controllers described in combination with other embodiments of adaptable lighting units described herein, may perform the steps of FIG. 7. At step 700 lighting configuration data specific to a lighting implementation is received. For example, the controller 650 may receive lighting configuration data from local memory that correlates to received lighting implementation data. At step 705 one or more lighting output characteristics is adjusted in accordance with the received lighting configuration data. For example, the controller 650 may adjust the light output characteristics of LEDs 641 to correspond according to the received lighting configuration data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing between parentheses in the claims are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. An adaptable LED-based lighting unit, comprising:

a plurality of LEDs producing a light output having at least one adaptable light output characteristic;

a controller electrically coupled to the plurality of LEDs and controlling the at least one adaptable light output characteristic in accordance with received lighting configuration data comprising light distribution or color temperature data; and an RFID reader to receive said lighting configuration data and transmit said lighting configuration data to said controller;

wherein said lighting configuration data is selected from a set of predefined lighting configuration data comprising light distribution or color temperature data, is received in response to integration of said LEDs within a particular lighting implementation, and is specific to said particular lighting implementation.

2. The adaptable LED-based lighting unit of claim 1, further comprising at least one RFID tag in communication with said controller, said RFID tag storing said lighting configuration data and transmitting said lighting configuration data to said RFID reader in response to integration of said LEDs within said particular lighting implementation.

3. The adaptable LED-based lighting unit of claim 1, wherein said at least one adaptable light output characteristic includes a dynamic light output characteristic.

4. The adaptable LED-based lighting unit of claim 1, wherein said at least one adaptable light output characteristic includes dimming that is controlled in accordance with said lighting configuration data.

5. A method of adapting an LED-based lighting unit to a particular lighting implementation, comprising:

receiving lighting implementation data indicative of a particular lighting implementation;

requesting predefined lighting configuration data comprising light distribution or color temperature data, and corresponding to said lighting implementation data;

receiving said predefined lighting configuration data; and adjusting at least one light output characteristic of LEDs of an LED-based lighting unit to achieve a predefined lighting configuration correlated with received lighting configuration data.

6. The method of claim 5, wherein said lighting implementation data includes at least one of specific lighting fixture, lighting fixture type, lighting fixture shape, and specific lighting effect.

* * * * *